United States Patent [19]

Adalbert et al.

[11] 3,989,490

[45] Nov. 2, 1976

[54] OIL SEPARATOR, ESPECIALLY FOR A COOLING MEDIUM COMPRESSOR

[75] Inventors: Gerhard Adalbert, Markgronengen; Hubert Dettling, Hohenacker; Jürgen Hess, Baden-Baden, all of Germany

[73] Assignee: Robert Bosch G.m.b.H., Stuttgart, Germany

[22] Filed: Oct. 7, 1974

[21] Appl. No.: 512,656

[30] Foreign Application Priority Data

Oct. 5, 1973 Germany ..... 2350015

[52] U.S. Cl. ..... 55/385 C; 55/473; 55/498; 55/DIG. 25; 418/99

[51] Int. Cl.[2] ..... B01D 29/04

[58] Field of Search ..... 55/185, 385, 473, 498, 55/500, 510, 525, DIG. 25, 485; 418/97–99

[56] References Cited

UNITED STATES PATENTS

| | | | |
|---|---|---|---|
| 1,639,132 | 8/1927 | Greene | 55/498 X |
| 1,780,156 | 11/1930 | Hall | 55/510 X |
| 2,230,278 | 2/1941 | Walton | 55/487 |
| 2,391,208 | 12/1945 | Walton | 55/DIG. 25 X |
| 2,510,049 | 5/1950 | Neeson | 55/510 X |
| 2,511,967 | 6/1950 | Campbell | 55/510 X |
| 3,228,174 | 1/1966 | Perry, Jr. | 55/185 X |
| 3,352,778 | 11/1967 | Brink, Jr. et al. | 55/185 X |
| 3,415,041 | 12/1968 | Kraissl, Jr. | 55/473 X |
| 3,494,111 | 2/1970 | Hathway | 55/510 X |
| 3,633,341 | 1/1972 | Langlois | 55/DIG. 25 X |
| 3,825,372 | 7/1974 | Lundberg et al. | 418/97 |
| 3,852,003 | 12/1974 | Adalbert et al. | 418/99 X |

*Primary Examiner*—Frank W. Lutter
*Assistant Examiner*—David L. Lacey
*Attorney, Agent, or Firm*—Michael J. Striker

[57] ABSTRACT

A compressor, particularly a cooling-medium compressor of a vehicle climate-control arrangement, has an exhaust outlet. An oil separator is connected to the exhaust outlet and comprises a cylindrical coagulator formed of a plurality of layers of wire fabric, and end plates closing off the opposite ends of the cylindrical coagulator, with one of the end plates being provided with an inlet opening for the inflow of a gas-oil mixture from the compressor exhaust outlet into the oil separator.

6 Claims, 5 Drawing Figures

OIL SEPARATOR, ESPECIALLY FOR A COOLING MEDIUM COMPRESSOR

BACKGROUND OF THE INVENTION

The invention relates to an oil separator which is arranged in the exhaust outlet of a compressor, especially a cooling medium compressor in a vehicle climate-control arrangement, and through which flows a mixture of gas and oil.

An oil separator is known in which the gas-oil mixture emerging from the compressor exhaust outlet is conducted into an annular chamber which opens in axial direction into helically extending guide channels. The guide channels are formed by the inclined teeth of an annular sheet-metal member. After the gas-oil mixture passes through the guide channels, it must pass through a frustoconically configurated coagulator comprised of filter material wound upon a spring. Beneath the coagulator there is arranged an oil collecting space. The interior of the frustoconical coagulator is connected to the exhaust outlet of the compressor. The separation of the oil from the gas in the gas-oil mixture must be completed after the gas-oil mixture flows through the coagulator. A disadvantage of this known oil separator construction is that the oil collecting space is arranged external to the coagulator. The oil droplets which in the coagulator are separated from the oil-gas mixture must accordingly pass through the coagulator in counterflow to the flow of gas. This results in flow losses in the gas and additionally impedes the oil separation.

SUMMARY OF THE INVENTION

It is a general object of the invention to provide an oil separator of the general type in question characterized by simple construction and by an improved oil-separating action.

This object, and others which will become more understandable from the description, below, of a preferred embodiment, can be met, according to one advantageous concept of the invention, by providing an oil separator of generally cylindrical form, with a casing constituted by a plurality of layers of wire fabric, with cover plates constituting end walls, and with one of the cover plates being provided with an axial inlet opening for the entry of the gas-oil mixture. This has the advantage that the gas-oil mixture entering into the oil separator through the cover plate provided with the inlet opening first impinges upon the opposite cover plate and is deflected very markedly, up to 90° ; during the subsequent flow of the mixture through the cylindrical casing of the oil separator, the flow velocity of the gas continually decreases in radially outwards direction due to the continual increase in the effective flow cross-section of the multi-layer wire-fabric casing. This enhances and improves the separation of the oil from the gas and the formation of larger-size oil droplets.

It has proved to be very advantageous to provide a plurality of oil separators, with the oil separators preferably being arranged pairwise in a chamber, preferably the interior of the compressor housing, disposed diametrically opposite to each other but with their axes in parallelism, and with their respective pairs of cover plates being arranged parallel to a common median plane.

The novel features which are considered as characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENT

Figure 1:
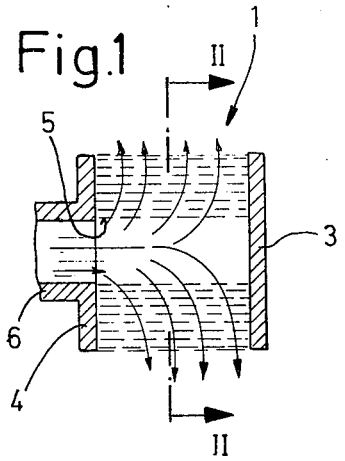
FIG. 1 is a longitudinal sectional view of one oil separator according to the invention.
Figure 2:
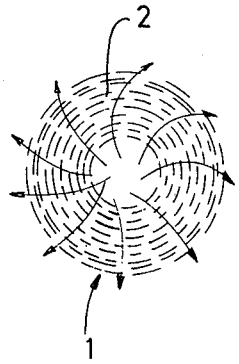
FIG. 2 is a sectional view taken along the line II—II of FIG. 1.

The oil separator depicted in FIGS. 1 and 2 is of generally cylindrical form. It is comprised of a casing 2 formed from a wrapping of wire mesh, gauze, netting, or the like, referred to herein for simplicity as a wire-fabric wrapping. The wire-fabric wrapping is composed of about seven or eight layers of superimposed wire fabric, such as mesh, gauze, netting or the like, and constitutes a coagulator. The end walls of the cylindrical casing 2 are constituted by solid cover plates 3, 4. The cover plate 4 is provided with a concentric inlet opening 5, the diameter of which corresponds to the internal diameter of the casing 2. Arranged on the cover plate 4 at the inlet opening 5 is a connecting pipe 6, the inner diameter of which corresponds to the inner diameter of the inlet opening 5. The metallic wire-fabric wrapping which forms the casing 2 is butt welded or soldered to the metallic cover plates 3, 4.

The gas-oil mixture is conveyed to the oil separator 1 through the connecting pipe 6. The inflowing gas mixture impinges first of all against the back cover plate 3 and is sharply deflected. A part of the liquid droplets contained in the gas stream likewise impinges upon the back cover plate 3, but because of the considerably higher inertia of such droplets they do not participate in the aforementioned sharp deflection. As the gas-oil mixture passes through the wire-fabric wrapping, small oil droplets which become caught on the surface of the wires of the wire fabric and in this manner become separated from the gas in the gas-oil mixture, combine to form larger oil droplets.

The flow velocity of the gas-oil mixture continually decreases as it passes radially outwards through the wire-fabric wrapping, due to the continual increase in the effective flow cross-section of the wire-fabric casing 2. This enhances the tendency for smaller drops of oil to combine to form larger drops of oil. As a result of the sudden decrease in the flow velocity of the gas stream emerging from the wire-fabric casing 2, the large and heavy drops of oil fall out of the oil separator directly downwards, and the now-purified pressurized gas can be conducted away.

Instead of the metallic cover plates 3, 4 depicted in the drawing, use can be made of synthetic plastic cover plates. Such cover plates would be advantageously cast onto the end portions of the prefabricated wire-fabric winding.

Figure 3:
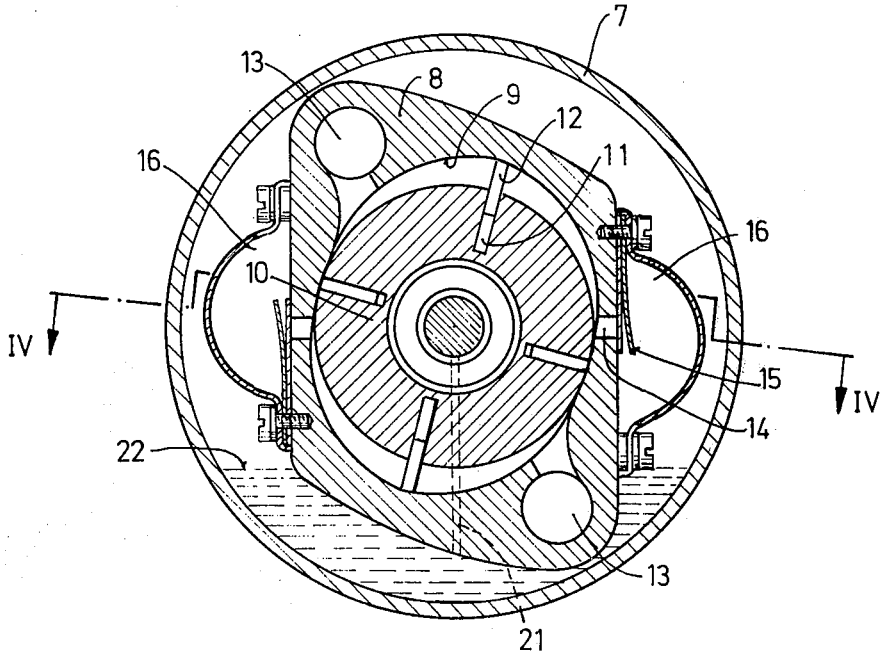
FIG. 3 is a transverse cross-sectional view of a cooling-medium compressor.
Figure 4:
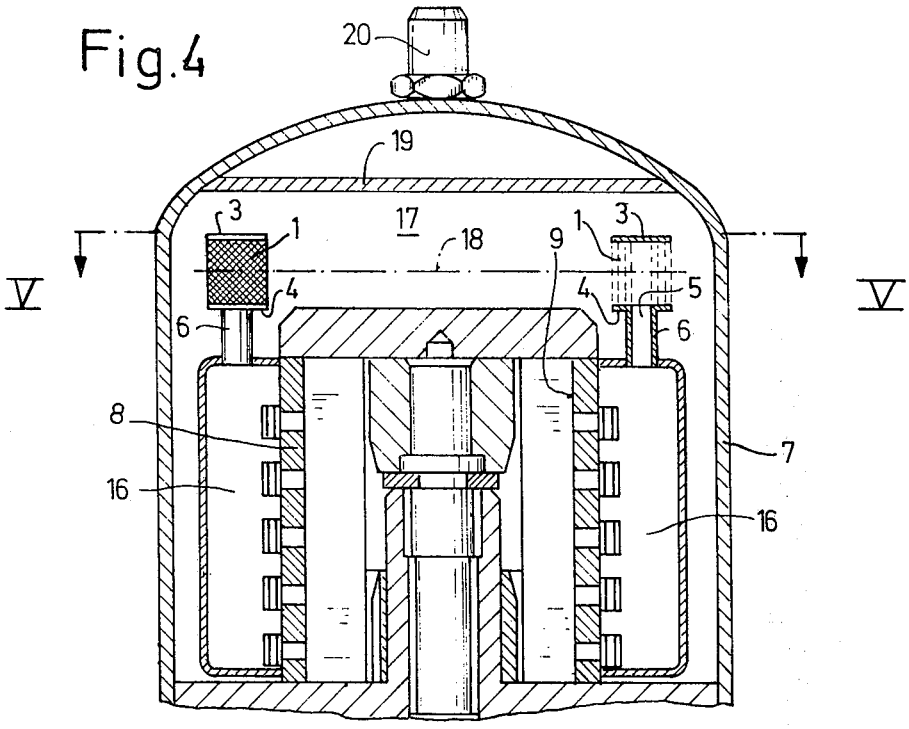
FIG. 4 is a sectional view taken along line IV—IV of FIG. 3.
Figure 5:
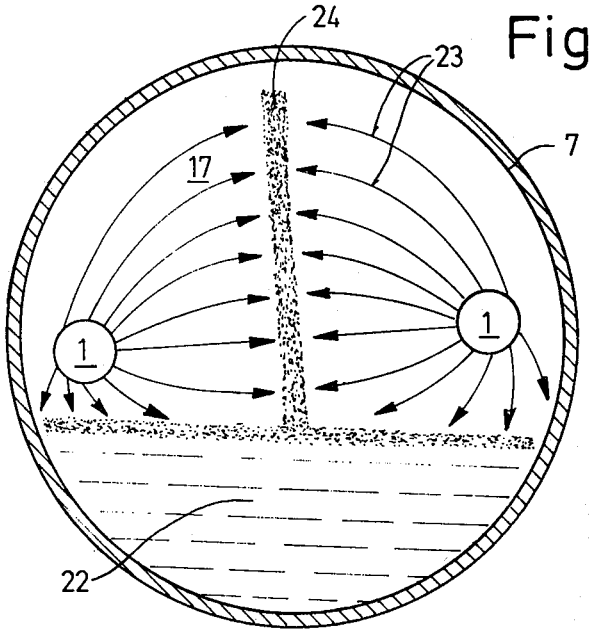
FIG. 5 is a sectional view taken along line V—V of FIG. 4.

In FIGS. 3–5 there is depicted a sliding-vane compressor provied with two oil separators according to the invention. The housing 8 of the sliding-vane compressor is arranged inside an outer casing 7. The housing 8 is provided with a cylindrical internal chamber 9, the cylindrical inner peripheral wall of which, serving as the control surface for the sliding vanes, is of elliptical cross-sectional configuration. Arranged inside the internal chamber 9 is a rotor 10. The outer peripheral surface of the rotor 10 defines with the peripheral wall of the internal chamber 9 two working chambers which are of generally sickle-shaped cross-sectional configuration.

The rotor 10 is provided with a plurality of radial slits 11 in which are seal-tightly but slidably mounted vanes 12. The vanes 12 are pressed with their outer edges against the cylindrical peripheral wall of internal chamber 9 and subdivide each of the two working chambers into individual cells. Each of the two sickel-shaped working chambers has a suction portion and a pressure portion. Each suction portion is connected by means of a respective inlet 13 to a feed conduit of the compressor. The pressure portion of each working chamber is provided with a respective outlet 14, which communicates via a respective flap-valve 15 with a respective pressure conduit 16.

As shown particularly clearly in FIG. 4, the two pressure conduits 16 communicate, via respective oil separators 1 corresponding in construction to that shown in FIGS. 1 and 2, with the interior of a jar-shaped outer casing 7 which completely encloses the entire sliding-vane compressor. Because the sliding-vane compressor, as explained above, is a double-flow machine, two pressure conduits 16 each provided with a respective oil separator 1 are employed. The two oil separators 1 are arranged in a chamber 17 formed between the outer casing 7 and the compressor housing 8, and are disposed diametrically opposite to each other, as seen particularly clearly in FIG. 5. The axes of the two oil separators 1 are oriented parallel to each other. Their respective cover plates 3 lie in a common plane, as do also their respective cover plates 4. Both the just-mentioned common planes are parallel to an imaginary median plane 18. Plane 18 is oriented normal to the axes of both separators 1 and bisects their respective wire-fabric casings 2. The two oil separators 1, as actually used in the compressor arrangement, are disposed with their respective axes both being horizontally oriented (see FIGS. 3 and 5). The axes of the two oil separators 1 together define a plane oriented approximately horizontally (see FIG. 5). The outlet 20 of the casing is arranged behind a deflecting wall 19 positioned near the axial end of the outer casing 7. Arranged in the housing 8 of the sliding-vane compressor is an oil conduit 21, by means of which the compressor is supplied with lubricating medium. The oil conduit 21 communicates with an oil supply 22 located in the compartment 17.

In operation of the compressor, compressed gas is exhausted into the pressure conduits 16 through the flap-type valves 15. This exhausted compressed gas is laden with finely divided oil droplets which are conveyed together with the gas, via the connecting pipe 6 and the inlet opening 5, into the oil separators 1 located in the space 17. Inside the oil separators 1 the separating action described above takes place. The oil drops are emitted from the two oil separators 1 in more or less radially outwards direction (see FIG. 5 in which the paths of travel of the oil drops are depicted schematically by means of arrows 23). The emitted oil drops from the two separators 1 collide with each other for the most part in the symmetry plane intermediate the two separators and there form a stable foam layer 24. As a result, smaller oil drops combine to form larger ones, markedly enhancing the overall separating action. This supplemental separating effect is greatest when the axes of the two oil separators 1 together define a plane which is horizontal or at least approximately horizontal, so that the foam layer 24 will have the orientation illustrated in FIG. 5. Due to the arrangement of the cover plates 3, 4 parallel to the aforementioned median plane 18, the two oil separators 1 are located directly opposite each other, as a result of which the oil droplets emitted from the two oil separators 1 travel the shortest distances before colliding with each other. For the foam layer 24 to form in the illustrated exemplary arrangement, it is necessary that the two oil separators be arranged symmetrical to each other; if the flow relationships of the oil droplets emitted from the two oil separators 1 are not the same, or if their paths of travel are not substantially the same, the foam layer 24 will not be established in a reliable manner, but at most by chance and in an irregular manner.

It will be understood that each of the elements described above, or two or more together, may also find a useful application in other types of constructions differing from the types described above.

While the invention has been illustrated and described as embodied in combination with a sliding-vane gas compressor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

What is claimed:

1. In combination with a compressor having exhaust outlet means through which the compressor during operation thereof expels a gas-oil mixture containing oil droplets, a pair of oil separators, casing means surrounding said separators and forming a closed chamber thereabout, said casing means also having vent means, each oil separator comprising a hollow cylindrical coagulator formed of a plurality of layers of wire fabric, each oil separator including two end plates closing off the opposite axial ends of the respective cylindrical coagulator, one end plate of each oil separator being provided with an inlet opening connected to the exhaust outlet means of the compressor for admitting the gas-oil mixture expelled from the exhaust outlet means into the interior of the hollow cylindrical coagulator to be expelled radially outward through the wire fabric of the hollow cylindrical coagulator, the cylindrical coagulators being disposed spaced from each other with the longitudinal axes of the coagulators being generally parallel and the axial ends of one coagulator being lined up with the axial ends of the other coagulator, the separators are spaced such that as gas-oil mixture is expelled from the two oil separators oil droplets in the gas-oil mixture expelled from the two separators will collide with each other in a zone intermediate the two separators and form a wall of foaming oil.

2. The combination defined in claim 1, wherein at least one end plate of each separator is soldered to the respective wire fabric coagulator.

3. The combination defined in claim 1, wherein at least one end plate of each separator is welded to the respective wire fabric coagulator.

4. The combination defined in claim 1, wherein at least one of the end plates of each separator is of synthetic plastic material and is cast around the respective end of the respective wire fabric coagulator.

5. The combination defined in claim 1, wherein said separators are connected to said outlet means such that said axes of said coagulators lies in the same horizontal plane.

6. The combination defined in claim 1, wherein said separators are connected to said outlet means such that said axes of said coagulators together define a plane which is oriented generally horizontal.

* * * * *